US005338211A

United States Patent [19]

Kodama et al.

[11] Patent Number: 5,338,211

[45] Date of Patent: Aug. 16, 1994

[54] CONNECTOR COVER STRUCTURE

[75] Inventors: Shinji Kodama, Shizuoka; Tsutomu Igarashi, Kosai, both of Japan

[73] Assignee: Yazaki Corporation, Tokyo, Japan

[21] Appl. No.: 971,610

[22] Filed: Nov. 6, 1992

[30] Foreign Application Priority Data

Nov. 21, 1991 [JP] Japan ..... 3-092426[U]
Feb. 25, 1992 [JP] Japan ..... 4-008283[U]

[51] Int. Cl.[5] ..... H01R 13/44

[52] U.S. Cl. ..... 439/135; 439/314; 439/489

[58] Field of Search ..... 439/314, 367, 369, 373, 439/147, 149, 135, 136, 142, 488, 489

[56] References Cited

U.S. PATENT DOCUMENTS 3,986,765 10/1976 Shaffer et al. ..... 439/314
4,343,526 8/1982 Hobson et al. ..... 439/314 X
4,531,800 7/1985 Avener ..... 439/314 X

FOREIGN PATENT DOCUMENTS 59-41579 11/1984 Japan .

*Primary Examiner*—Khiem Nguyen
*Attorney, Agent, or Firm*—Jacobson, Price, Holman & Stern

[57] ABSTRACT

A connector cover structure employed as a connector for electrical wires in an automobile is made of a synthetic resin, has a substantially cylindrical form and has, on an inner wall thereof, abutting walls which make engagement with a proximal end portion of one connector member and abutting walls which make engagement with grooves provided at a proximal end portion of the other connector member. Thus, incomplete fitting of the connector members can be detected, the entire connector can be protected and a reliable electrical connection can be provided.

4 Claims, 8 Drawing Sheets

CONNECTOR COVER STRUCTURE

BACKGROUND OF THE INVENTION

1. Field of the Invention

The present invention relates to a cover of a connector used in automobile connections, and more particularly, to a connector cover structure which enables an incomplete fitting of male and female connector members to be detected or which promotes complete fitting of the male and female connector members.

2. Description of the Prior Art

A conventional connector cover employed in an electrical connection for an automobile is designed to cover the portion of an electric wire which is connected to a male connector member and is formed of a synthetic resin continuously from the male connector member. The male connector member is fitted into and is coupled with a female connector member by making an engaging claw of the male connector member engage with an engaging hole in the outer surface of the female connector member. Although such a cover protects the electric wire, it does not protect the male and female connector member bodies. Thus, the conventional cover cannot be used at a site where a stone may strike, such as in an engine compartment of the vehicle. Furthermore, when the male and female connector members are fitted with each other incompletely, the male connector member may come off the female connector member due to vibrations.

SUMMARY OF THE INVENTION

An object of the present invention is to provide a connector cover structure which can protect an entire connector and which can prevent detachment of the connector.

To achieve the aforementioned object, the present invention provides a connector cover structure for protecting the male connector member and the female connector member which are fit together featuring that the cover structure is made of a synthetic resin, has a substantially cylindrical form, and can be divided into two portions through a thin hinge which extends in a longitudinal direction of the cover structure, and in that the cover structure has, on an inner wall surface, abutting walls which make engagement with a rear end portion of the one connector member and abutting walls which make engagement with an engagement means provided at a base of the other connector member.

The present invention further provides a connector cover structure for protecting the female connector member and the male connector member which are fit together featuring in that the cover structure is made of a synthetic resin, has a substantially cylindrical form, and has an opening through which the one connector member is inserted, and in that the cover structure has, on a portion of an inner wall surface which is located near the opening, an engaging protrusion which is inserted into a notch of a retaining flange provided at a base of the other connector member and which slides against and makes engagement with a rear surface of the retaining flange by pivot of the cover structure, and at a portion of the inner wall remote from the opening, an abutting wall which makes engagement with a rear end of the one connector member. In this structure, the retaining flange has an inclined guide which continues from the notch, and a locking shoulder portion.

In the first connector cover structure, when the male and female connector members are fit together incompletely, the abutting walls provided on the inner surface of the cover abut the connector, thus preventing closure of the cover. It is thus possible to readily detect an incomplete fitting.

In the second connector cover structure, after the one connector member has been accommodated in the cover beforehand, the one connector member is inserted into and fitted with the other connector member. At that time, the engagement protrusion provided on the port ion of the inner surface located near the opening of the cover is inserted into the notch formed on the retaining flange of the other connector member and the cover is pivoted to make the protrusion slide along and thereby engaged with the rear surface of the retaining flange. If the two connector members are fitted incompletely, the protrusion cannot be brought into engagement. Thus, abnormality can be immediately detected. In that case, pushing of the cover in a direction in which the connector members are fitted with each other readily provides complete fitting. In a structure in which the retaining flange has an inclined guide which continues from the notch, and a locking shoulder portion, if the connector members are incompletely fitted with each other, since the abutting wall of the cover pushes the rear end of the one connector member due to an axial force generated by the sliding of the protrusion along the inclined guide surface, complete fitting of the connector members is achieved.

Other objects, advantages and features of the present invention will be apparent from the following description taken in connection with the accompanying drawings.

DESCRIPTION OF THE PREFERRED EMBODIMENTS

Figure 1:
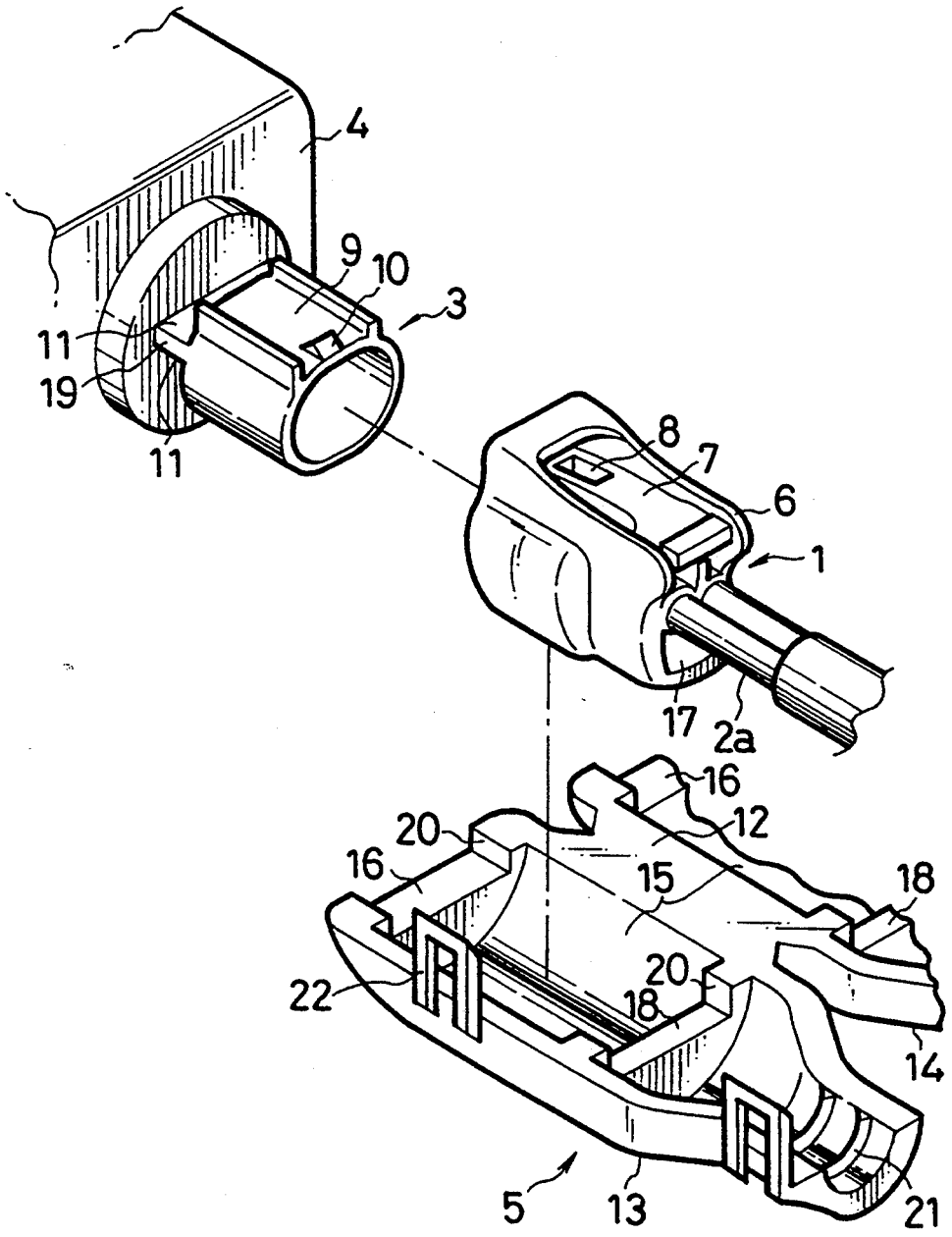
FIG. 1 is an exploded perspective view of a first embodiment of a connector cover structure according to the present invention.
Figure 2:
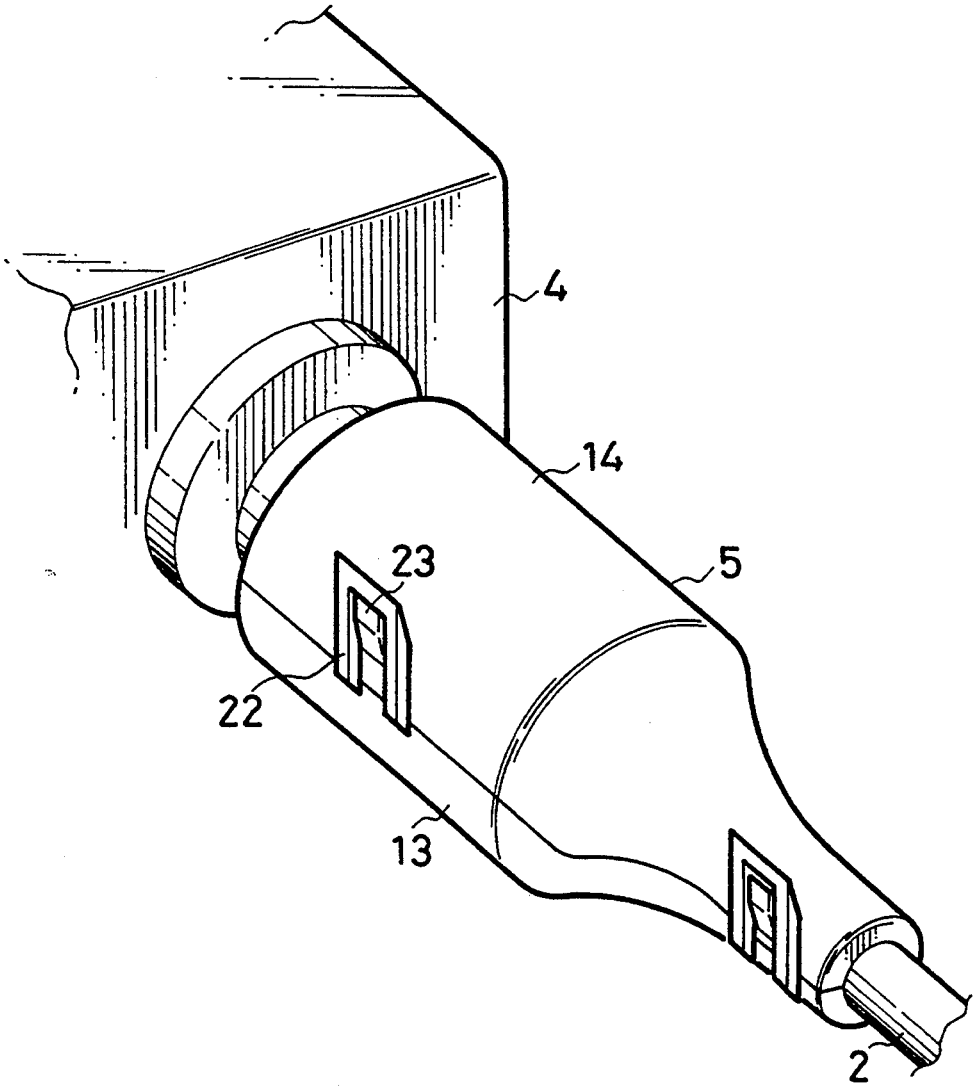
FIG. 2 is a perspective view showing an assembly of FIG. 1.

In a first embodiment shown in FIGS. 1 and 2, a male connector member connected to electric wires 2*a* opposes a female connector member 3 protruding from a joint box 4. A cover 5 made of a synthetic resin encloses both connector members 1 and 3 in an opposing state.

The male connector member 1 is brought into engagement with the female connector member 3 by the engagement of an engaging hole 8 in a flexible locking arm 7 provided on an outer wall 6 of a housing of the male connector member 1 with a locking protrusion 10 provided on an outer wall 9 of a housing of the female connector member 3. The female connector member 3 has, on a base thereof, a pair of grooves 11 which extend in a direction of the diameter of the female connector member 3 and which make the female connector member 3 engage the cover 5.

The cover 5 is a substantially cylindrical member which can be divided into two portions through a thin hinge 12 which runs in the longitudinal direction thereof. The cover 5 includes an upper cover member 13 and a lower cover member 14. The cover members 13 and 14 have a pair of abutting walls 16 which oppose the grooves 11 of the female connector member 3 at the forward ends of inner walls 15 thereof. The cover members 13 and 14 also have a pair of abutting walls 18 which face a rear end surface 17 of the male connector member 1 at the rear ends of the inner walls 15 thereof. The two connector members 1 and 3 are accommodated between the pair of abutting walls 16 and the pair of abutting walls 18 without backlash in the longitudinal direction.

The abutting walls 16 have recesses 20 which oppose side walls 19 of the grooves of the female connector member 3. The abutting walls 18 have recesses 20 which oppose the electric wires 2*a* of the male connector member 1. The cover 5 has, on a rear end thereof, an electric wire protecting portion 21 having a smaller diameter than the remaining of the male connector member 1 so that it can accommodate the electric wire 2. As shown in FIG. 2, the lower and upper cover members 13 and 14 are closed by the engagement of a locking frame member 22 provided on the lower cover member 13 with a locking protrusion 23 provided on the outer side of the upper cover member 14.

Figure 3:
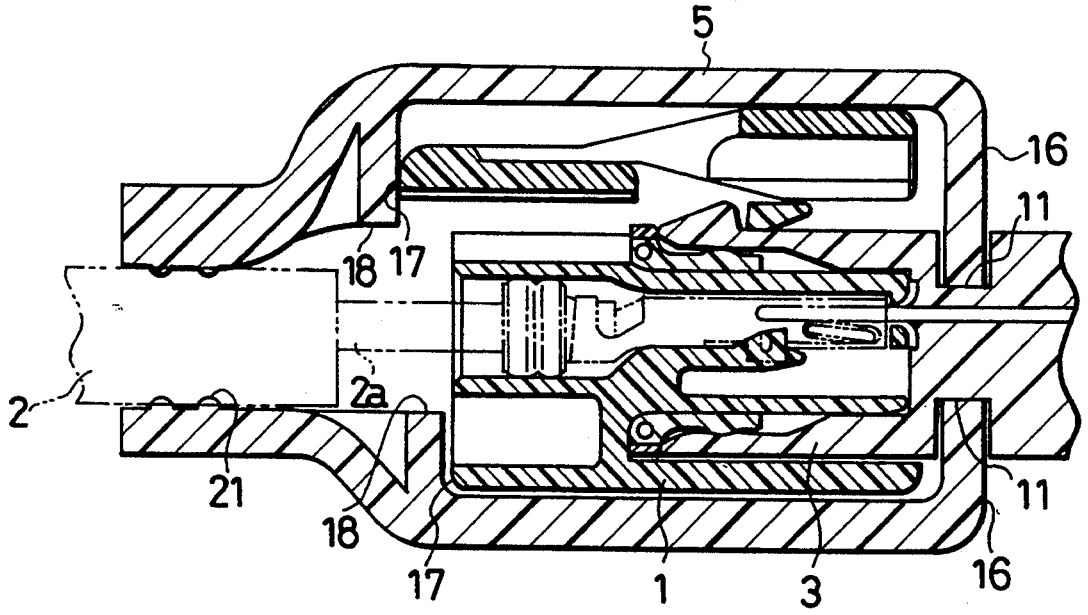
FIG. 3 is a longitudinal cross-sectional view illustrating a complete assembly of FIG. 1.

FIG. 3 illustrates how the cover 5 is assembled on the connector members 1 and 3 which are fit together. The abutting walls 16 provided at the forward end of the cover are in engagement with the grooves 11 of the female connector member 3, and the abutting walls 18 provided at the rear end of the cover are located near the rear end surface 17 of the male connector member 1. The electric wire protecting portion 21 of the cover 5 grips the electric wires 2. Since the cover 5 is mounted on the connector members 1 and 3 without the backlash (without the play), it can protect not only the electric wire connecting portion 2*a* but also the entire connector.

Figure 4:
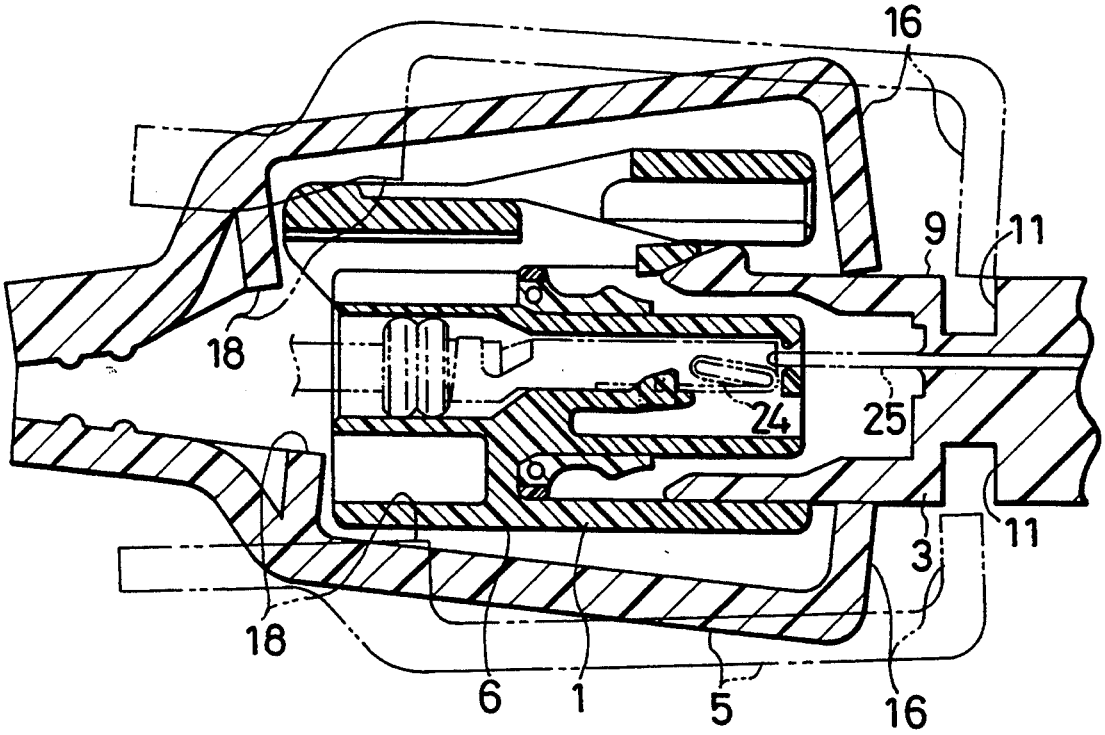
FIG. 4 is a longitudinal cross-sectional view illustrating detection of an incomplete fitting of the connector of FIG. 1 by a cover.

FIG. 4 shows the mounting of the cover 5 on the connector members 1 and 3 which are incompletely fitted with each other. The abutting walls 16 provided at the forward end of the cover 5 are not in engagement with the grooves 11 of the female connector member 3 but in abutment with the outer wall 9 of the housing, making closing of the cover 5 impossible. Alternatively, as shown by the broken line, even if the abutting walls 16 are in position, the abutting walls 18 provided at the rear end of the cover 5 are in abutment with the outer wall 6 of the housing of the male connector member 1, thus preventing closing of the cover 5. Since an incomplete fitting of the connector members 1 and 3 is detected by the cover 5, a failure of the connection between connector terminals 24 and 25 can be prevented.

Figure 5:
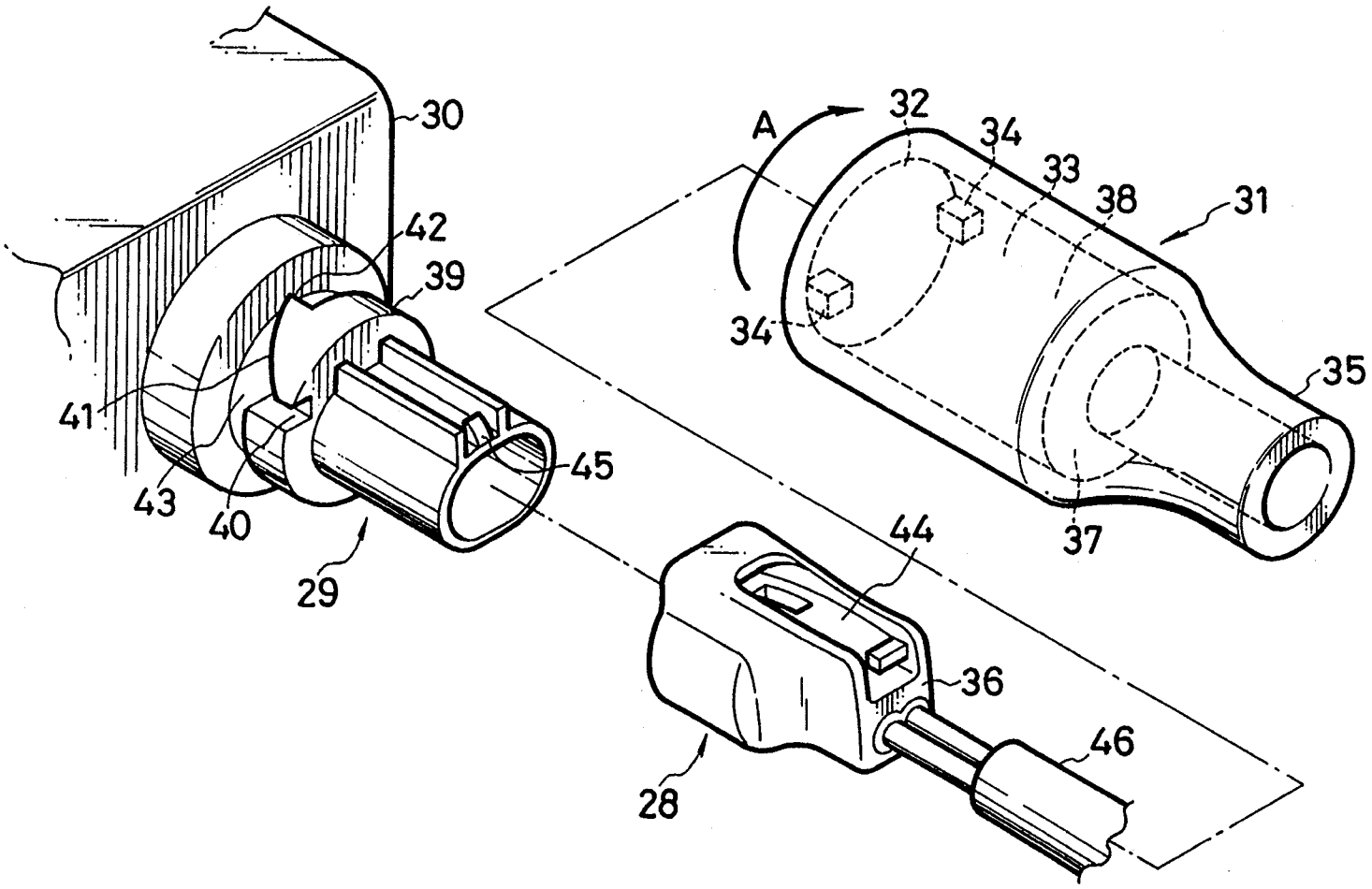
FIG. 5 is an exploded perspective view illustrating a second embodiment of a connector cover structure according to the present invention.

In a second embodiment shown in FIG. 5, a male connector member 28 and a female connector member 29 protruding from a joint box 30 are protected by a substantially cylindrical cover 31 made of a synthetic resin in a state where they oppose each other.

The cover 31 has an opening 32 through which the connector is inserted thereinto at an forward end thereof. A pair of engaging protrusions 34 protrude from an inner wall surface 33 of the opening 32, and an abutting wall 37 which makes abutment with a rear end surface 36 of the male connector member 28 is provided at a rear end, i.e., an electric wire protecting portion 35, of the cover 31. Thus, a connector accommodating space 38 is formed between the opening 32 and the abutting wall 37.

At the base of the female connector member 29, an annular retaining flange 39 is formed integrally with the female connector member 29. The retaining flange 39 has a cover engaging means 43 including a notched groove 40 through which each of the engaging protrusions 34 of the cover 31 are inserted, an inclined guide 41 which is notched obliquely from the inlet of the notched groove 40 toward the rear surface of the retaining flange 39, and a locking shoulder portion 42 formed at the end of the inclined guide 41.

Figure 6:
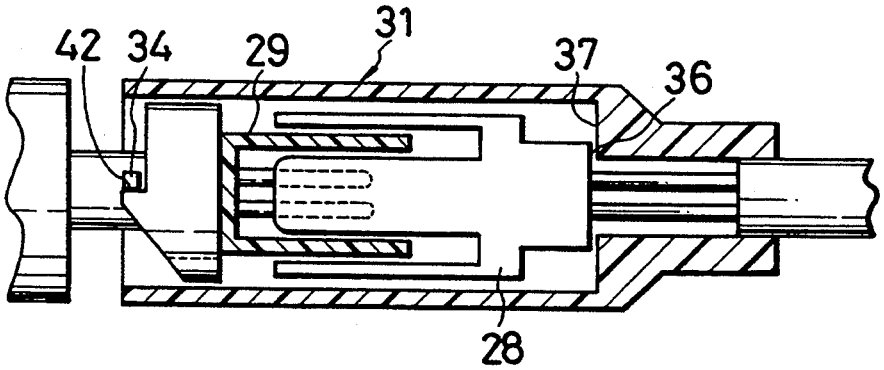
FIG. 6 is a longitudinal cross-sectional view illustrating an assembly of FIG. 5.

The female connector member 29 and the male connector member 28 are locked with each other by the engagement of a locking arm 44 with a locking protrusion 45. The male connector member 28 is inserted into the cover 31 from the electric wire 46 thereof beforehand. Alternatively, the cover 31 may be a two-part cover, as in the case of the first embodiment, which is mounted after the fitting of the connector members 28 and 29. Thereafter, each of the engaging protrusions 34 of the cover 31 is inserted into the notched groove 40 of the female connector member 29, the cover is pivoted in a direction indicated by an arrow A to move the engaging protrusion 34 along the inclined guide 41 thereby make the protrusion 34 engaged with the locking shoulder portion 42. As shown in FIG. 6, when the engaging protrusion 34 of the cover 31 is locked by the locking shoulder portion 42 of the female connector member 29, the abutting wall 37 provided at the rear end of the cover 31 is located near or is brought into abutment with the rear end surface 36 of the male connector member 29, whereby the cover 31 is mounted without the backlash in the direction in which the connector members are fitted with each other.

Figure 7:
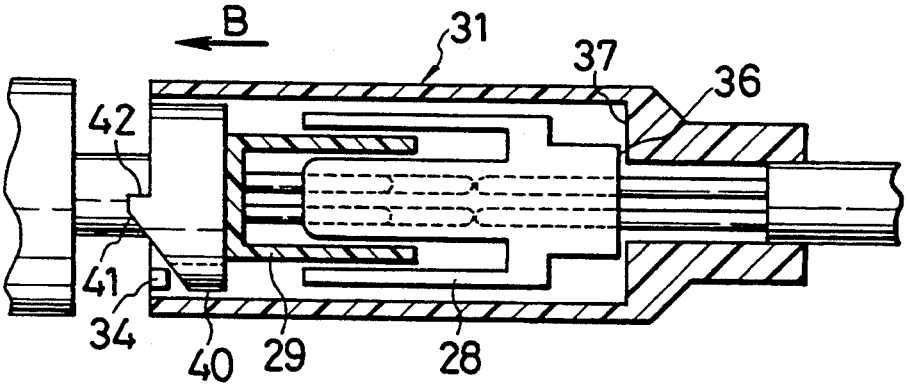
FIG. 7 is a longitudinal cross-sectional view illustrating correction of an incomplete fitting of the connector of FIG. 5 by the cover.

In the cover 31 of the second embodiment, even if the connector members 28 and 29 are initially fitted with each incorrectly, as shown in FIG. 7, when the cover 31 is pivoted in a direction indicated by an arrow A after the engaging protrusion 34 has been inserted into the notched groove 40 of the female connector member 29, the engaging protrusion 34 moves slantingly in a forward direction along the inclined guide 41, moving the cover 31 in the direction indicated by the arrow B and making the connector members 28 and 29 fitted with each other and mounted. At that time, the abutting wall 37 of the cover 31 pushes the rear end surface 36 of the male connector member 28 in a direction in which the connector members are fitted with each other. Concurrently with the fitting of the connector members 28 and 29, the engaging protrusion 34 is brought into engagement with the locking shoulder portion 42, as shown in FIG. 6, to fix the cover 31.

Figure 8:
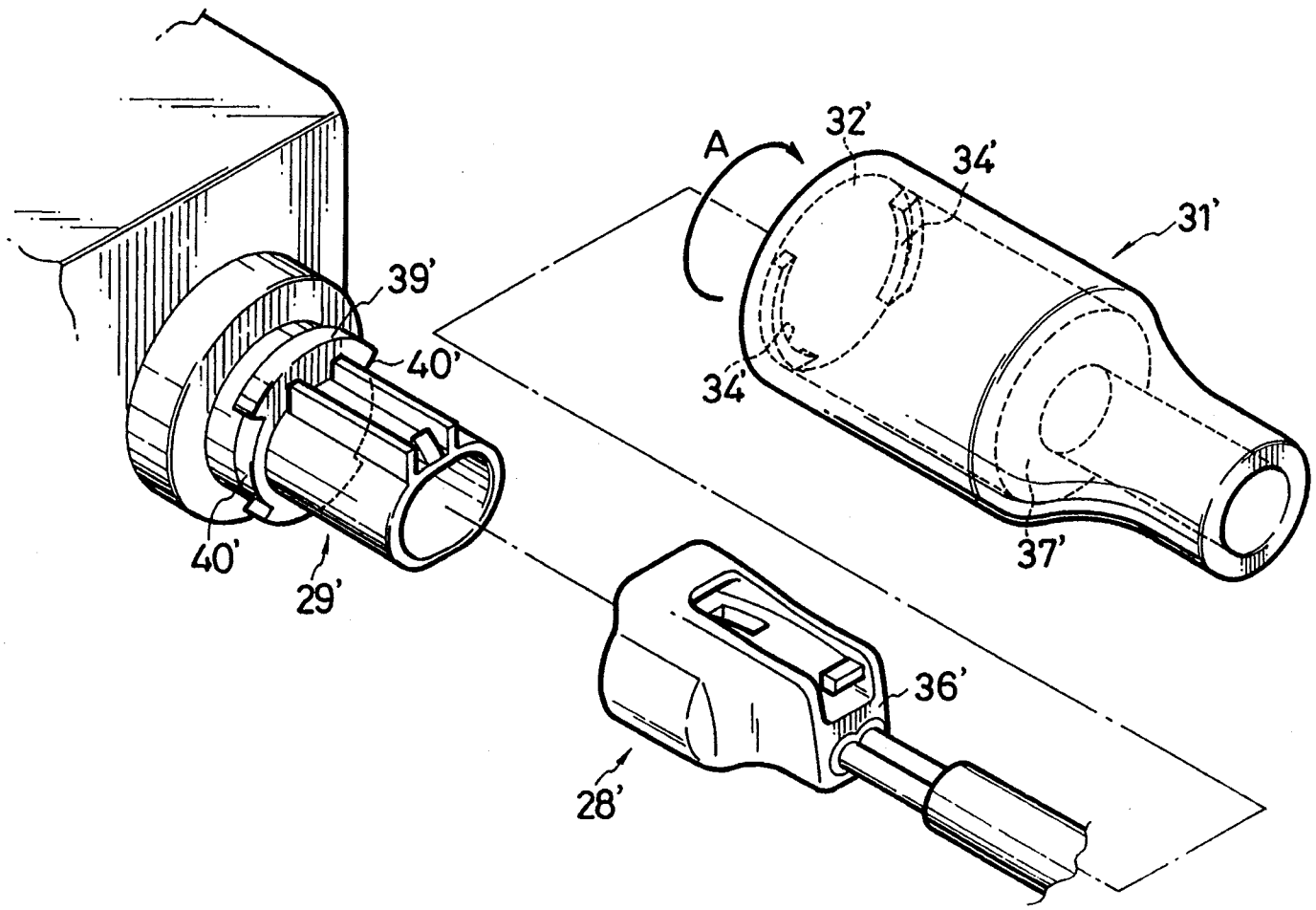
FIG. 8 is an exploded perspective view showing a modification of the second embodiment according to the present invention.

FIG. 8 shows a modification of the second embodiment. In this structure, a pair of engaging protruding strips 34' are provided on the inner side of an opening 32' of the cover 31', and a pair of inserting notches 40' which oppose the engaging protruding strips 34' are provided on a flat plate-like retaining flange 39' of the female connector member 29'. The cover 31' may also be a two-part one which is divided through a hinge which is not shown.

Figure 9:
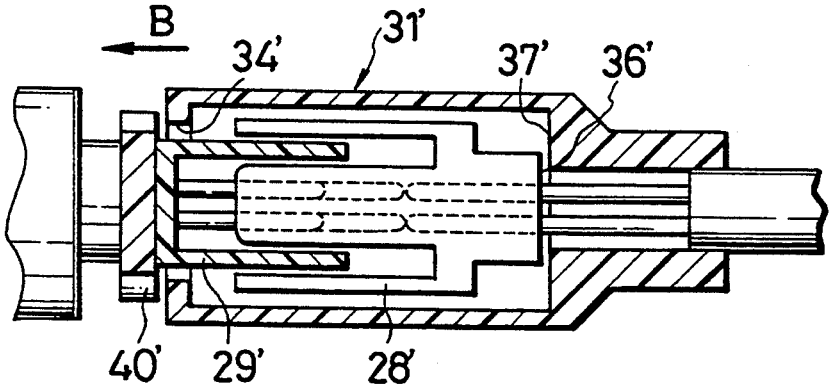
FIG. 9 is a longitudinal cross-sectional view illustrating a process of the fitting of a connector of FIG. 8.
Figure 10:
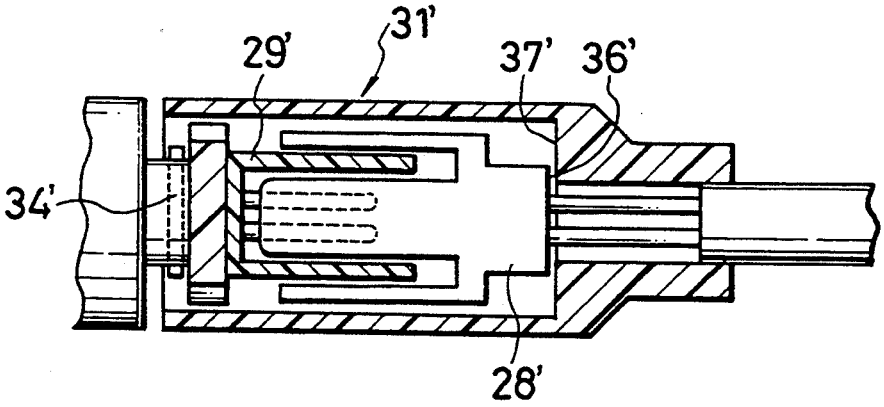
FIG. 10 is a longitudinal cross-sectional view illustrating a state in which assembly of FIG. 8 is completed.

As shown in FIGS. 9 and 10, after a male connector member 28' and the female connector members 29' are fitted with each other, the engaging protruding strips 34' are inserted into the notches 40' and are then brought into engagement with the rear surface of the retaining flange 39' by pivoting the cover 31' in a direction indicated by the arrow A. Alternatively, a rear end surface 36' of the male connector member 28' is pushed in the direction indicated by the arrow B by an abutting wall 37' of the cover 31' to fit the male connector member 28' with the female connector member 29' and thereby bring the engaging protruding strips 34' with the retaining flange 39'. If the fitting between the connector members 28' and 29' is incomplete, it is impossible to make the engaging protruding strips 34' engaged with the retaining flange 34', abnormality of the fitting can thus be readily detected.

As will be understood from the foregoing description, in the present invention, since an incomplete fitting of the connector can be detected when the cover is mounted or since the connector members are completely fitted with each other forcibly by the mounting of the cover, coming-off of the connector can be prevented while a reliable electrical connection can be provided.

What is claimed is:

1. A connector cover structure for protecting a male electrical connector member and a female electrical connector member which are to be fit together the cover structure comprising:

a cover made of a synthetic resin, having a substantially cylindrical shade, and being divided into two half portions through a thin hinge which extends in a longitudinal direction of said cover, said cover having an inner wall surface, a first abutting wall on the inner wall surface which engages a rear end portion of the male electrical connector member and a second abutting wall which makes engagement with an engagement means provided at a base of the female electrical connector member, the cover capable of closing around said male and female electrical connector members only when said rear end portion of the male electrical connector member and engagement means of the female electrical connector member establish a predetermined orientation with respect to the first abutting wall and the second abutting wall, respectively, indicative of a complete connection between the male and female electrical connector members.

2. A connector cover structure according to claim 1, wherein said engagement means provided at the base of the female electrical connector member comprises a pair of grooves provided at a base thereof and which grooves extend substantially parallel to a diameter of the female electrical connector member.

3. A connector cover structure according to claim 1, wherein the one connector member comprises a male connector member while the other connector member comprises a female connector member protruding from a joint box.

4. The connector cover structure of claim 1, wherein the cover further comprises a locking frame member on one half portion and a locking protrusion on the other half portion, the locking protrusion fitting into and locking with the locking frame member only when said cover is properly closed around the completely connected male and female electrical connector members.

* * * * *

UNITED STATES PATENT AND TRADEMARK OFFICE

CERTIFICATE OF CORRECTION

PATENT NO. : 5,338,211

DATED : August 16, 1994

INVENTOR(S) : Shinji KODAMA et al

It is certified that error appears in the above-identified patent and that said Letters Patent is hereby corrected as shown below:

Col. 6, line 3, claim 1 , change "shade" to --shape--.

Signed and Sealed this

Fourteenth Day of February, 1995

Bruce Lehman

*Attest:*

BRUCE LEHMAN

*Attesting Officer*

*Commissioner of Patents and Trademarks*